US006114808A

United States Patent [19]

Takahashi

[11] Patent Number: 6,114,808

[45] Date of Patent: Sep. 5, 2000

[54] COLD CATHODE ELECTRON GUN FOR MICROWAVE TUBE

[75] Inventor: Masaaki Takahashi, Tokyo, Japan

[73] Assignee: NEC Corporation, Tokyo, Japan

[21] Appl. No.: 09/047,331

[22] Filed: Mar. 25, 1998

[30] Foreign Application Priority Data

Mar. 27, 1997 [JP] Japan ..... 9-075456

[51] Int. Cl.[7] ..... H01J 25/34; H01J 23/04

[52] U.S. Cl. ..... 315/3.5; 315/5; 315/5.33; 313/309; 313/351

[58] Field of Search ..... 315/3.5, 5, 5.33; 313/309, 351

[56] References Cited

U.S. PATENT DOCUMENTS 2,842,703 7/1958 Preist ..... 315/5.33 X
5,604,401 2/1997 Makishima ..... 315/5.33 X

FOREIGN PATENT DOCUMENTS 57-163952 10/1982 Japan .
57-185659 11/1982 Japan .

OTHER PUBLICATIONS

A. S. Gilmour, Jr., "Principles of Traveling Wave Tubes", Artech House, pp. 432–433 and 440–441.

*Primary Examiner*—Benny T. Lee
*Attorney, Agent, or Firm*—Sughrue, Mion, Zinn, Macpeak & Seas, PLLC

[57] ABSTRACT

A cold cathode electron gun includes a field emission cathode array type cold cathode for emitting electron beams toward an RF circuit unit of a microwave tube. An annular Wehnelt electrode, a first anode electrode and a second anode electrode are disposed in order from the field emission cathode array type cold cathode side coaxially with the field emission cathode array type cold cathode between the field emission cathode array type cold cathode and the RF circuit unit. The potential Ea1 of the first anode electrode, the potential Ea2 of the second anode electrode and the potential Eb of the RF circuit unit has a relationship of Ea1>Eb>EA2≧0 V.

6 Claims, 10 Drawing Sheets

COLD CATHODE ELECTRON GUN FOR MICROWAVE TUBE

BACKGROUND OF THE INVENTION

1. Field of the Invention

This invention relates to an electron gun which forms an electron beam using a cold cathode of the field emission cathode array (FEA) type and a microwave tube such as a traveling wave tube or a klystron for which the cold cathode electron gun is used.

2. Description of the Related Art

A conventional microwave tube will be described with reference to the drawings taking a traveling wave tube as an example.

As shown in FIG. 1, the conventional traveling wave tube includes a hot cathode electron gun 110 for forming an electron beam 108, an RF circuit unit 115 having a helix 116 for performing a mutual action between a microwave and the electron beam 108 to effect amplification of the microwave, and a collector 120 for catching the electron beam 108. The hot cathode electron gun 110 has a beam convergence ratio selected in most cases within the range from 15 to 40 in order to keep the current density of a cathode 101 at a suitable value to ensure long life, and an electron gun of the converging type called Pierce type is used for the hot cathode electron gun. In the hot cathode electron gun 110, the surface of the cathode 101 has a spherical shape, and a converging electric field is formed by a Wehnelt electrode 102 and an anode electrode 103 to converge the electron beam 108 while maintaining the laminar flow property of the electron beam 108.

For a cathode which serves as a source of generation of electrons, a cold cathode which does not require heating is available in addition to such a hot cathode as described above.

Next, a cold cathode of the field emission cathode array (FEA) type is described with reference to FIGS. 2*a* and 2*b*. FIG. 2*a* is a perspective view, partly cut away, of a conventional cold cathode of the FEA type, and FIG. 2*b* is a sectional view of essential part of the cold cathode of the FEA type. As seen from FIGS. 2*a* and 2*b*, an insulating layer 132 formed from a silicon oxide and a gate electrode 133 are layered on a silicon substrate 131. The insulating layer 132 and the gate electrode 133 are partly removed to form cavities 136 (see FIG. 2*b*), in each of which an emitter 134 having a pointed end is formed, thereby forming electron emitting sections 135 (see FIG. 2*a*). The electron emitting sections 135 are arranged in an array to form a cold cathode of the FEA type having a planar electron emitting area.

The thickness of the insulating layer 132 is approximately 1 $\mu$m, and also the diameter of the openings of the gate electrode 133 is approximately 1 $\mu$m. Further, the extremity of each emitter 134 has a radius of approximately 10 nm and is very sharp. Then, if the electric field strength becomes higher than 2 to $5\times10^7$ V/cm, then electrons are emitted from the extremities of the emitters 134.

The cold cathode of the FEA type can realize a cold cathode current density which is five to ten times as high as that of a hot cathode. Further, since the cold cathode does not require heating different from the hot cathode, no heater power is required.

With a cold cathode electron gun of the FEA type, since the surface of the cathode is flat, where the beam convergence ratio is set equal to that of the hot cathode, if a converging electric field is formed by a Wehnelt electrode and an anode electrode similarly as in an electron gun of the Pierce type, then the trajectories of electron beams on the outer side of the cold cathode are curved more strongly to the center axis side than the trajectories of electron beams on the inner side of the cold cathode. Consequently, the beam trajectories cross over each other, resulting in loss of the laminar flow property of the electron beams. As a result, a stable electron beam having a low ripple percentage required for a microwave tube cannot be obtained. Besides, in the cold cathode of the FEA type, since each electron is emitted from the extremity of an emitter at an angle of approximately 10 to 30 degrees with respect to the direction of a normal to the surface of the cathode, electrons tend to expand in radial directions. As a result, convergence of the electron beams becomes more difficult.

In order to solve the problems described above, the applicant of the present application has proposed a cold cathode electron gun which employs an annular cold cathode in Japanese Patent Application No. 291453/96. FIG. 3 shows a sectional view including a center axis of the cold cathode electron gun proposed in Japanese Patent Application No. 291453/96 by the applicant of the present application.

Referring to FIG. 3, an annular cold cathode 141 has a large number of electron emitting sections 141*a* having a gate voltage(s) of $E_G$, disposed annularly. Wehnelt electrodes 142 and 143 maintained at voltages Ew, and $Ew_2$ are disposed at a central portion and a peripheral portion of the cold cathode 141. It is to be noted that reference numeral 144 denotes an anode electrode having a voltage of Ea. The ratio d/D between the inner diameter d and the outer diameter D of the region in which the electron emitting sections 141*a* are formed is higher than 0.8. By the construction just described, an influence of electron emitting angles from the extremities of emitters of the cold cathode 141 is moderated, and electron beams are converged from the inner side and the outer side by the two Wehnelt electrodes 142 and 143. Consequently, electron beam trajectories having a high laminar flow property and a low ripple percentage can be obtained. While the cold cathode 141 described above can be applied to an electron gun which has a comparatively high convergence ratio of approximately 20, the arrangement structure of the Wehnelt electrodes 142 and 143 is complicated, and this makes miniaturization and reduction in cost difficult.

Since the cold cathode of the FEA type can achieve a high current density comparing with the hot cathode, even if the convergence ratio is set lower than 10, usually there is no problem in regard to the life. Further, although the laminar flow property of electron beams is augmented by a decrease in convergence ratio, with an electron gun of the Pierce type, since the magnetic flux density in the proximity of the cathode increases in inverse proportion to the beam convergence ratio, if it is intended to decrease the convergence ratio, then the magnetic flux density in the proximity of the cathode must be increased. If the convergence ratio is set lower than 10, then the magnetic flux density usually becomes higher than several hundreds Gauss. Since such a high magnetic flux density cannot be obtained with the electron gun side leakage magnetic field of an electron beam converging magnet, an electron gun structure wherein the magnet is disposed outwardly of the electron gun cannot be avoided, and this makes the electron gun very large. Accordingly, an optimum structure of a cold cathode electron gun of the FEA type having a low convergence ratio is not known as yet.

Meanwhile, as an electron gun of a low convergence ratio, an example of a hot cathode electron gun for a low noise traveling wave tube is described below.

An electron gun having such a construction as shown in FIG. 4 is disclosed in A. S. Gilmour, Jr., "PRINCIPLES OF TRAVELING WAVE TUBES", Artech House, p.432. The electron gun shown in FIG. 4 includes an annular planar hot cathode 151, a Wehnelt electrode 152, and four anode electrodes 153, 154, 155 and 156. When the potential of the planar hot cathode 151 is 0 V, the potential of the Wehnelt electrode 152 is +12.5 V and the potential of the anode electrode 153 which is positioned nearest to the planar hot cathode 151 is +2.5 V. Further, in order to minimize standing waves of space-charge waves which propagate noise, where the potentials of the anode electrodes 153, 154, 155 and 156 are represented by Va1, Va2, Va3 and Va4 and the potential of a helix electrode (such as the one shown in FIG. 5) disposed forward of an end of the anode electrode 156 is represented by Ehe1, they have a relationship of Va1<Va2<Va3<Va4<Ehe1.

Further, on page 441 of the document mentioned above the characteristics of, such an electron gun as shown in FIG. 5 are disclosed. The electron gun includes a Wehnelt electrode and three anode electrodes. Reference symbols a, b, c, d and h in FIG. 5 denote the Wehnelt electrode, the first, second and third anode electrodes and the helix, respectively, and where the potentials of the anode electrodes and the helix are represented by Vb, Vc, Vd and Vh, respectively, they have a relationship of Vb<Vc<Vd<Vh.

In the electron guns shown in FIGS. 4 and 5, in order to achieve noise reduction, a lateral direction velocity component of an electron beam must be eliminated. Therefore, the beam convergence ratio is set to approximately 1 and cannot be set positively higher than 1. Further, in order to minimize standing waves of space-charge waves which propagate noise, the potential distribution from the cathode to the helix must be made smooth, and usually, three or more anode electrodes are used.

Further, as an example of an electron gun which employs a planar cathode and a plurality of anode electrodes, an electron gun for a cathode ray tube is known.

For example, such an electron gun for a cathode ray tube as shown in FIG. 6 is disclosed in Japanese Patent Laid-Open Application No. 185659/82. The electron gun produces electron beam 168 using a beam forming electrode 166 and a converging electrode 165. The beam forming electrode 166 includes a planar hot electrode 161, a control grid electrode 162, a first screen grid electrode 163 and a second screen grid electrode 164. Where the potentials of the control grid electrode 162, first screen grid electrode 163, second screen grid electrode 164 and converging electrode 165 are represented by V1, V2, V2' and V3, respectively, they have relationships of V1=V2' and V2>V2'. As concrete values, V1=V2'=0 V, V2=628 V, V3=690 V, and the cathode potential =47.5 V are disclosed. By setting the potentials of the control grid electrode 162 and the second screen grid electrode 164 lower than the cathode potential and besides setting the potential of the first screen grid electrode 163 to a value lower than 10 percent of the potential of the converging electrode 165 in this manner, there is an effect that expansion of electron beams 168 which have crossed over each other can be suppressed to make the beam spot diameter on the surface of the cathode ray tube small.

Meanwhile, such an electron gun for a cathode ray tube as shown in FIG. 7 is disclosed in Japanese Patent Laid-Open Application No. 163952/82. The electron gun includes a electron beam forming unit 174 including a planar hot cathode 171, a first grid electrode 172 and a second grid electrode 173, and a main converging lens unit 175 including a plurality of grid electrodes. The potential of the first grid electrode 172 is positive with respect to the cathode potential, and the potential of the second grid electrode 173 is negative with respect to the cathode potential. Due to the construction described, the electron gun has an effect that the degree of the cross-over of electron beams 178 can be reduced to reduce the beam spot diameter on the surface of the cathode ray tube.

As described above, an electron gun for a cathode ray tube includes a beam forming unit for causing electron beams to cross over each other, and a main converging unit for accelerating and converging the crossed over electron beams, and has totaling four or more electrodes.

In order to allow an electron gun for a microwave tube including a cold cathode of the FEA type to produce good electron beams having a low ripple percentage and having a suitable beam diameter, the following problems are involved.

First, where the beam convergence ratio is high, while an electron gun of a structure wherein Wehnelt electrodes are disposed on both of the inner and outer sides of a cold cathode having annular electron emitting sections is available, this structure is complicated and it is difficult to miniaturize and reduce the cost of the electron gun.

Second, where the beam convergence ratio is low, while an electron gun for a low noise traveling wave tube is suggestive, since the cathode current of the electron gun is several hundreds $\mu$A and extremely low so as to achieve low noise operation, if the electron gun is applied as it is to an electron gun for a microwave tube which usually requires electric current of several tens mA or more, then electron beams are diverged by the space-charge forces of electrons and good electron beams cannot be obtained.

On the other hand, while also the electron gun structure for a cathode ray tube is suggestive as a planar cathode electron gun, since an electron gun for a cathode ray tube requires totaling four or more grid electrodes, the structure of the electron gun is complicated, and where it is applied to an electron gun for a microwave tube, it is difficult to achieve miniaturization and reduction in cost.

As described above, for an electron gun for a microwave tube which includes a cold cathode of the FEA type, a simple and small-size structure for obtaining good electron beam trajectories has not been established as yet.

SUMMARY OF THE INVENTION

It is an object of the present invention to provide a cold cathode electron gun for a microwave tube which has electron beam trajectories having a low ripple percentage and is small in size and a microwave tube which employs the electron gun.

In order to attain the object described above, a cold cathode electron gun for use with a microwave tube which includes an RF circuit unit comprises a field emission cathode array type cold cathode for emitting electron beams, and an annular Wehnelt electrode, a first anode electrode and a second anode electrode disposed in order from the field emission cathode array type cold cathode side coaxially with the field emission cathode array type cold cathode between the field emission cathode array type cold cathode and the RF circuit unit. The potential of the first anode electrode is represented by Ea1, the potential of the second anode electrode is represented by Ea2 and the potential of the RF circuit unit is represented by Eb, the potentials has a relationship of $$Ea1>Eb>EA2\geqq 0\ \text{V}$$

In the cold cathode electron gun of the present invention described above, electron beams emitted from the field emission cathode array type cold cathode are converged by the Wehnelt electrode and the first anode electrode within a range within which the laminar flow property of the electron beams is not disturbed. In this instance, since the potential of the first anode electrode is set higher than the potential of the RF circuit unit, the influence of radial velocity components of the emitted electron beams is moderated and the cold cathode can be protected from an ion impact by an ion barrier effect. Consequently, a cold cathode electron gun having a long life can be achieved. Further, since the potential of the second anode electrode is set higher than 0 V but lower than the potential of the RF circuit unit, an electric field lens is formed between the second anode electrode and the RF circuit unit and main convergence of the electron beams is performed by the electric field lens. Accordingly, electron beams having a good laminar flow property and having a low ripple percentage are formed.

Also from the phase of the structure, since the cold cathode electron gun of the present invention can be formed from a single Wehnelt electrode and two anode electrodes, it can be formed with a small size and a light weight.

Further, since the potential of the second anode electrode is low, even if the electron beam convergence ratio is lower than 10, the magnetic flux density in the proximity of the cathode can be made as low as an order of magnitude of $10^3$ Gauss. As a result, no magnet is required to be arranged on the outside of the cathode, and the effect of the reduction in size and weight is promoted by this. Besides, since the convergence ratio is lower than 10, electron beams having a good laminar flow property and having a low ripple percentage can be obtained also where high current of several tens mA and more is used.

Furthermore, where the radius of an inner circumference of the Wehnelt electrode is larger than twice the radius of an electron emitting area of the field emission cathode array type cold cathode and the potential of the Wehnelt electrode is equal to the gate potential of the field emission cathode array type cold cathode, the trajectories of the electron beams are prevented from crossing the center axis of the electron emitting area of the cold cathode. Consequently, the laminar flow property is improved.

A microwave tube of the present invention comprises an electron gun for forming an electron beam, an RF circuit unit for amplifying a microwave by a mutual action between the microwave and the electron beam from the electron gun, and a collector for catching the electron beam which has passed through the RF circuit unit, and for the electron gun, one of the cold cathode electron guns of the present invention described above is used.

In this manner, since the cold cathode electron gun of the present invention is used, the electron gun is reduced in size, and consequently, also the overall microwave tube is reduced in size and weight. Further, since an electron beam having a good laminar flow property and a low ripple percentage is obtained, not only a good electron beam characteristic is obtained, but also a stabilized radio frequency characteristic is obtained. Further, a microwave tube for a millimeter wave band, which cannot be put into practical use readily using a hot cathode, can be put into practical use.

The above and other objects, features and advantages of the present invention will become apparent from the following description with reference to the accompanying drawings which illustrate examples of the present invention.

DESCRIPTION OF THE PREFERRED EMBODIMENTS

First Embodiment

Figure 1:
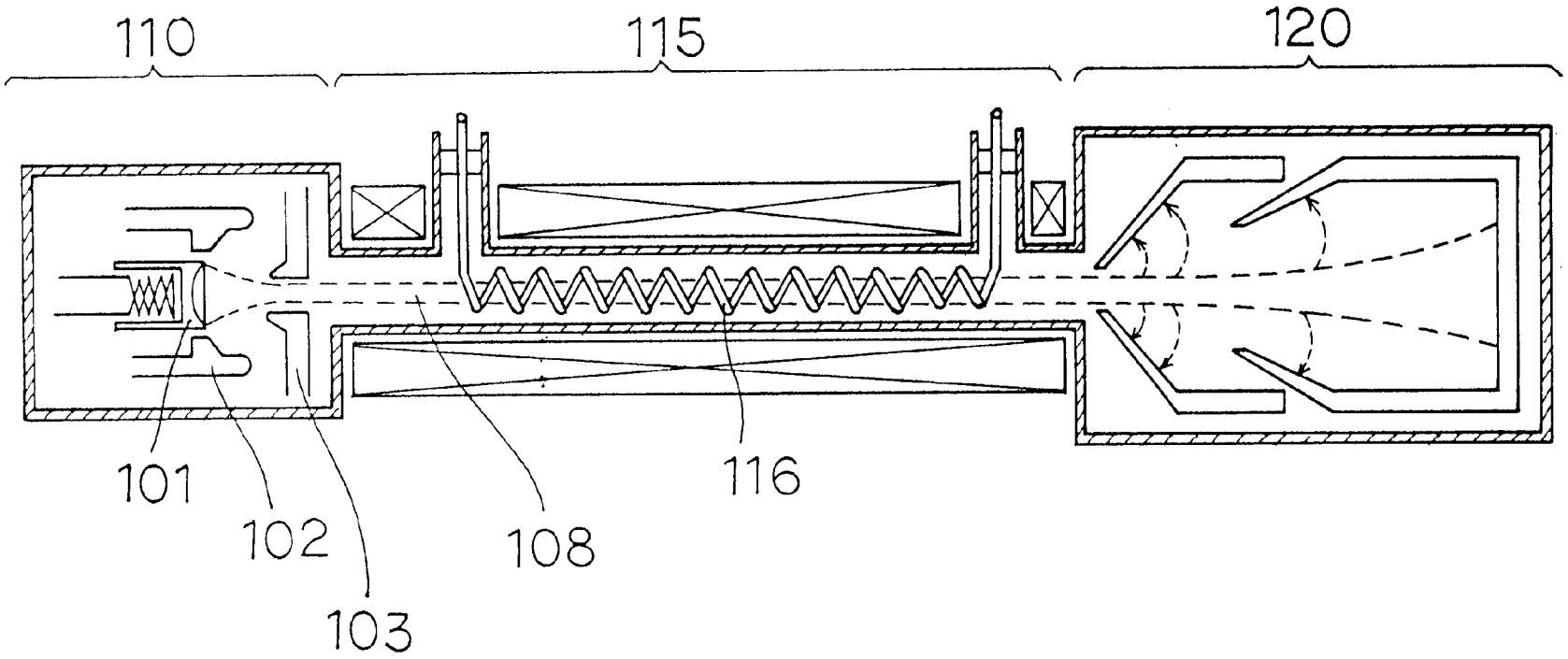
Fig. 1 (Prior Art)
FIG. 1 is a schematic sectional view of a conventional traveling wave tube.
Figure 2A:
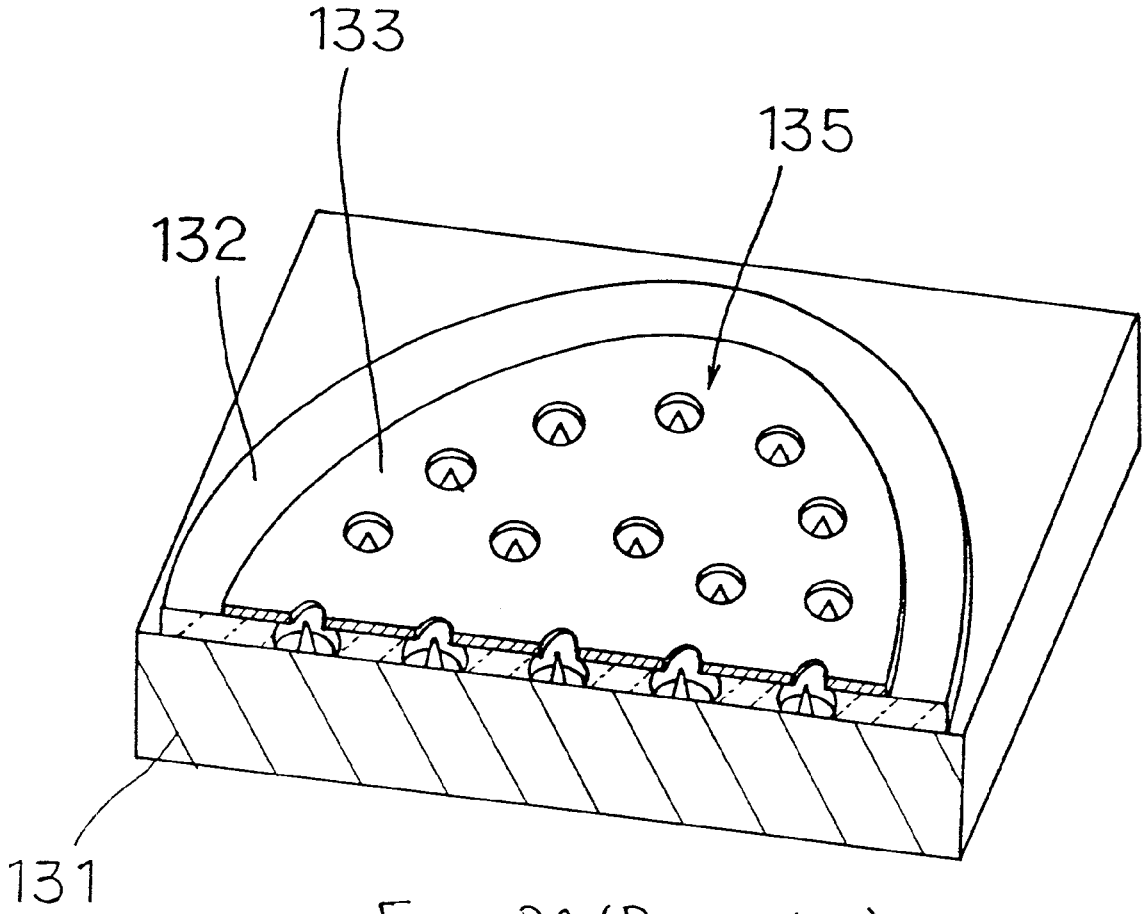
Fig. 2a (Prior Art)
FIG. 2*a* is a perspective view, partly cut away, of a conventional cold cathode of the field emission array type.
Figure 2B:
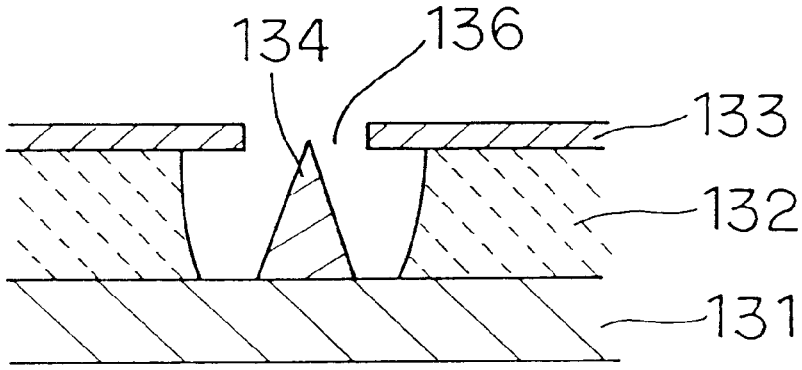
Fig. 2b (Prior Art)
FIG. 2*b* is a sectional view of essential part of the cold cathode.
Figure 3:
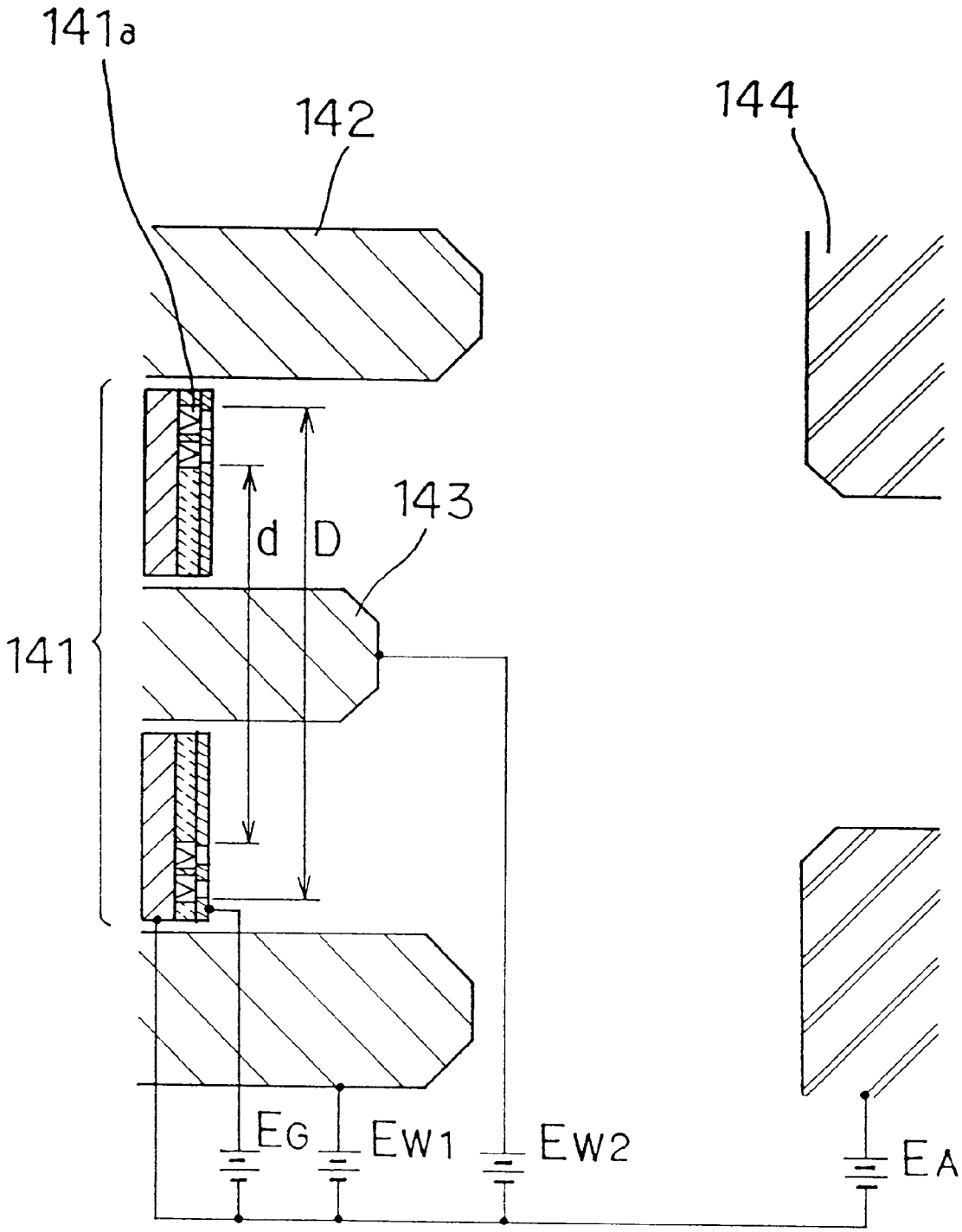
Fig. 3 (Prior Art)
FIG. 3 is a schematic sectional view of a cold cathode electron gun disclosed in a preceding patent application of the applicant of the present patent application.
Figure 4:
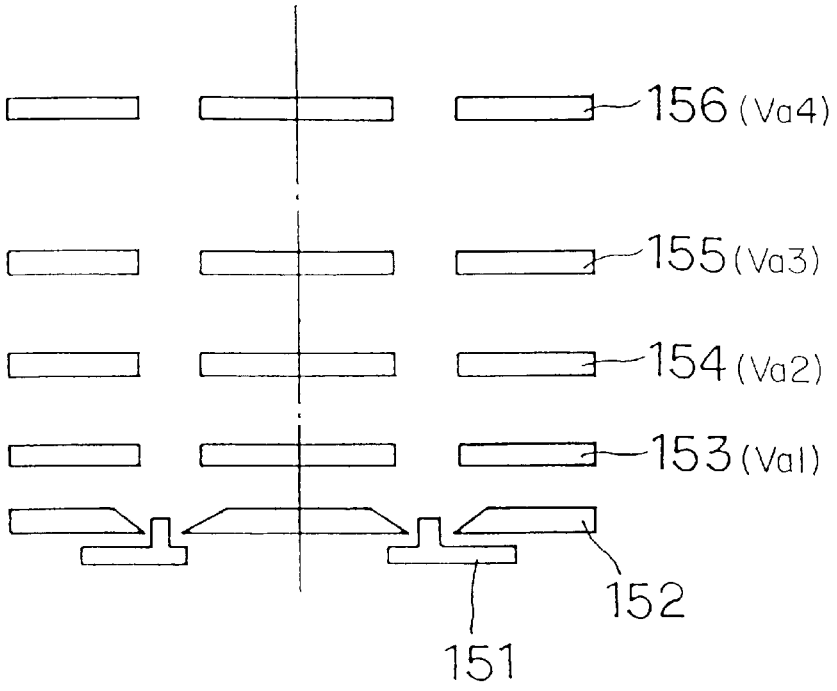
Fig. 4 (Prior Art)
FIG. 4 is a schematic view showing an example of a conventional hot cathode electron gun for a low noise traveling wave tube.
Figure 5:
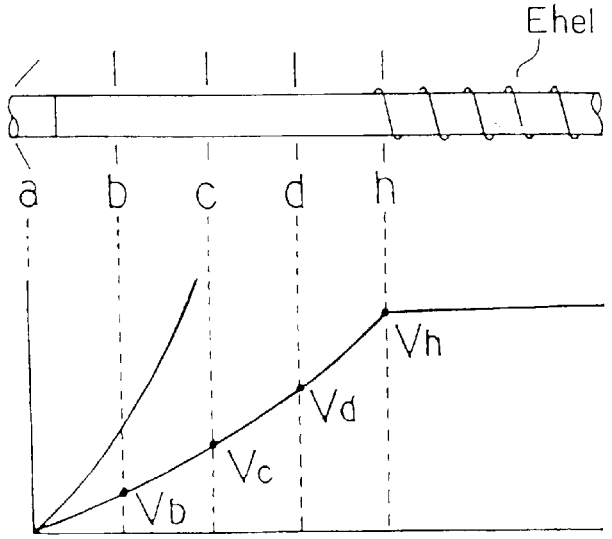
Fig. 5 (Prior Art)
FIG. 5 is a schematic view showing another example of a conventional hot cathode electron gun for a low noise traveling wave tube.
Figure 6:
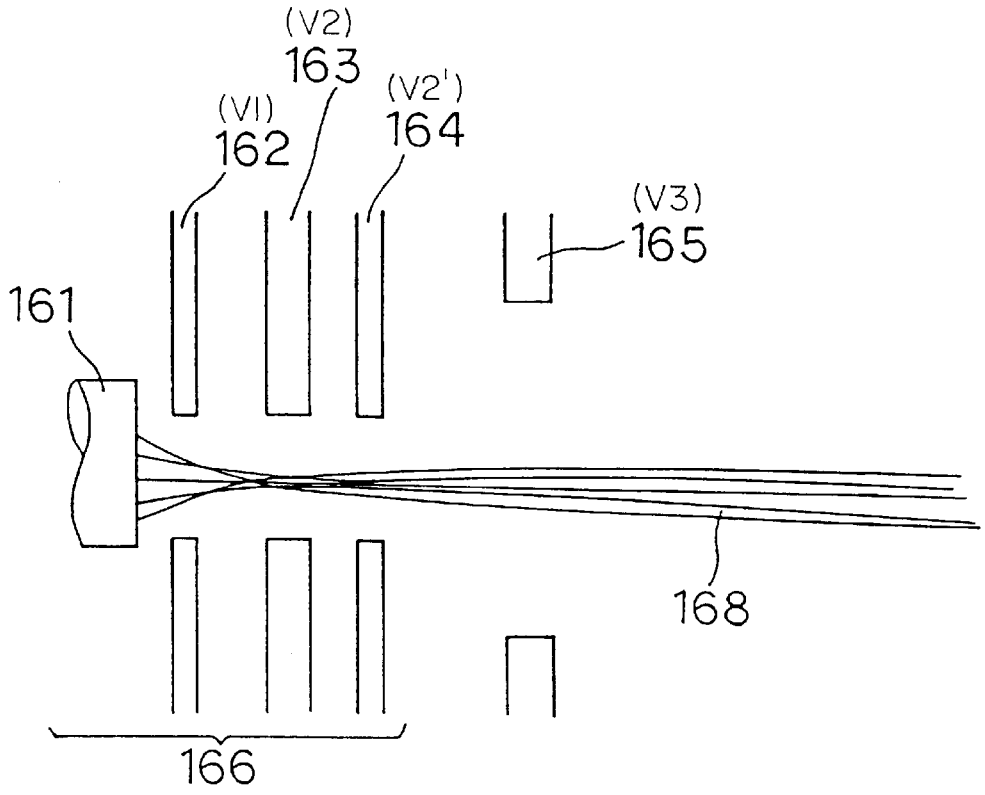
Fig. 6 (Prior Art)
FIG. 6 is a schematic view showing a construction of a conventional example of an electron gun for a cathode ray tube.
Figure 7:
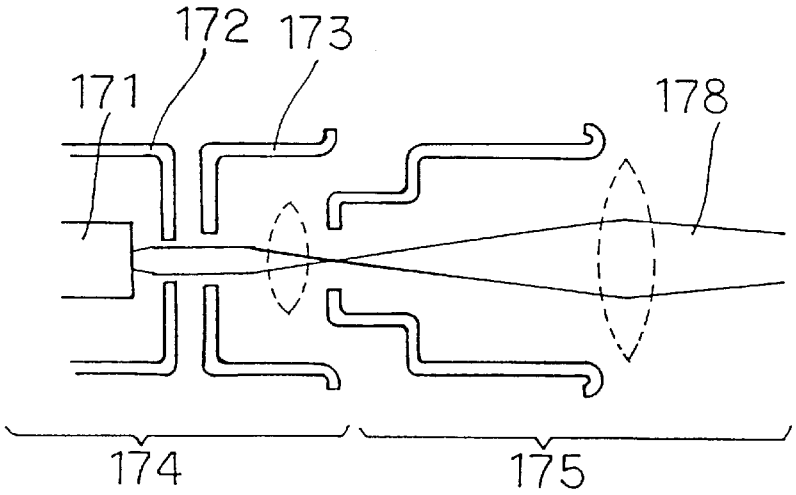
Fig. 7 (Prior Art)
FIG. 7 is a schematic view showing a construction of another conventional example of an electron gun for a cathode ray tube.
Figure 8:
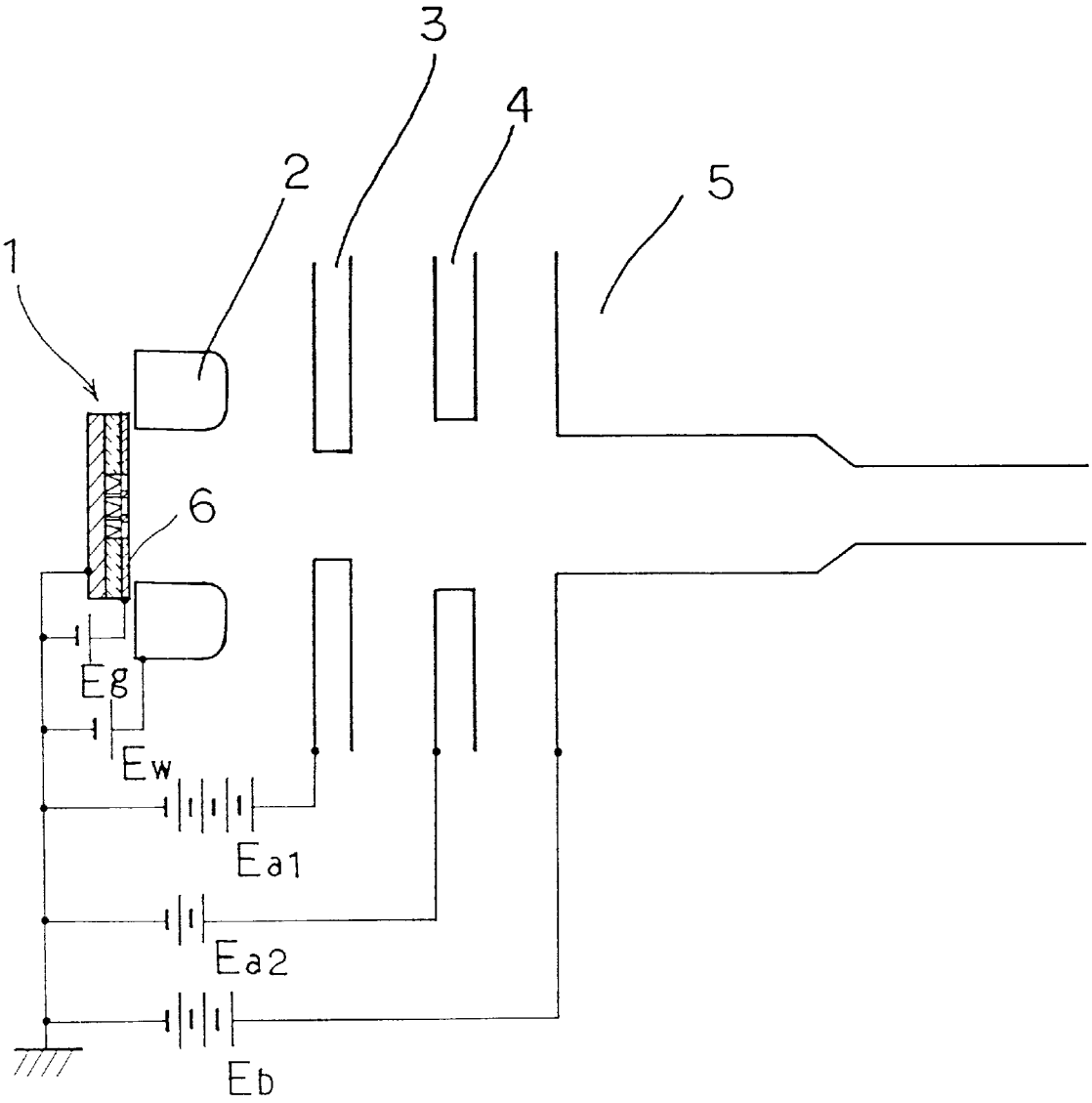
FIG. 8 is a schematic view showing a construction of a cold cathode electron gun and showing a first embodiment of the present invention.

First, a cold cathode electron gun of a first embodiment of the present invention is described with reference to FIG. 8. Referring to FIG. 8, a cold cathode 1 of the field emission cathode array (FEA) type emits electron beams toward an RF circuit unit 5 of a microwave tube, and between the FEA type cold cathode 1 and the RF circuit unit 5, a Wehnelt electrode 2, a first anode electrode 3 and a second anode electrode 4 are disposed in order from the FEA type cold cathode 1 side. Since the structure of the FEA type cold cathode 1 is similar to the structure described hereinabove with reference to FIG. 2, description thereof is omitted here.

The Wehnelt electrode 2, first anode electrode 3 and second anode electrode 4 are each in the form of an annular electrode and are disposed coaxially with the FEA type cold cathode 1.

The potential (hereinafter referred to as "gate potential") Eg of a gate electrode 6 of the FEA type cold cathode 1 is set to a value with which necessary cathode current can be obtained. The potential (hereinafter referred to as "Wehnelt potential") Ew of the Wehnelt electrode 2 is usually set to a value within a range of approximately ±100 V with respect to the gate potential Eg. The potential (hereinafter referred to as "first anode potential") Ea1 of the first anode electrode 3, the potential (hereinafter referred to as "second anode potential") Ea2 of the second anode electrode 4 and the potential (hereinafter referred to as "body potential") Eb of the RF circuit unit 5 have a relationship of $$Ea1>Eb>Ea2\geqq 0\ \text{V} \quad (1)$$

Since electron beams emitted from the FEA type cold cathode 1 have an initial velocity which depends upon the gate potential Eg of the FEA type cold cathode 1 and divergence angles (hereinafter referred to as "electron beam divergence half angles") of 10 to 30 degrees with respect to a normal to the gate electrode surface, they have high velocity components in diametrical directions of the FEA type cold cathode 1. Consequently, if the electron beams are left as they are, then they are expanded diametrically and good electron beam trajectories cannot be obtained. Further, if converging the electron beams using only a converging electric field lens formed by the Wehnelt electrode 2 and the first anode electrode 3, is attempted then those electron beams which are emitted from an outer peripheral portion of the FEA type cold cathode 1 are curved to the inner side more strongly than those electron beams emitted from the other portion of the FEA type cold cathode 1. Consequently, the beam trajectories cross over each other and this disturbs the laminar flow property, resulting in deterioration of the ripple percentage. Accordingly, the electron beams must be converged without disturbing the laminar flow property thereof.

In the present invention, the converging electric field lens formed from the Wehnelt electrode 2 and the first anode electrode 3 provides the electron beams only with such weak convergence that the laminar flow property of the electron beams is not disturbed. Principal convergence of the electron beams is performed by an electric field lens system formed from the second anode electrode 4 and the RF circuit unit 5. The first anode electrode 3 acts to moderate the influence of diametrical velocity components of the electron beams by accelerating the electron beams emitted from the FEA type cold cathode 1 in an axial direction with the first anode potential Ea1 higher than the body potential Eb. Simulation has proven that, in this instance, in order to obtain electron beams having a low ripple percentage in the RF circuit unit 5 without deteriorating the laminar flow property of the electron beams, the first anode potential Ea1 must be set higher than the body potential Eb. Since the second anode potential Ea2 is set to a potential higher than 0 V but lower than the body potential Eb, the electron beams are converged by the electric field lens system formed from the second anode electrode 4 and the RF circuit unit 5. The strength of the convergence is adjusted and optimized by the second anode potential Ea2.

As described above, by defining the potentials of the electrodes as presented by the expression (1) above, the influence of the divergence angles of electron beams emitted from the FEA type cold cathode 1 and the influence of the flat surface of the FEA type cold cathode 1 are moderated, and electron beams having a good laminar flow property and a low ripple percentage are formed.

Further, although the velocities of the electron beams in the direction of rotation increase if the magnetic flux density in the proximity of the cathode increases, since the second anode potential Ea2 is low, when the velocities of the electron beams drop toward zero in the proximity of the second anode electrode 4, the axial velocities of the electron beams drop extremely as the kinetic energy is constant, and this sometimes causes a phenomenon that the electron beams increase their thickness very much or the beam trajectories are reversed. In order to prevent such phenomenon, in the electron gun of the present embodiment, the magnetic flux density in the proximity of the cathode is set very low, to an order of magnitude of $10^3$ Gauss. Where the convergence ratio is as low as 10 or less, while an electron gun of the Pierce type requires at least 200 Gauss as the magnetic flux density around the cathode, it can be recognized that, with the electron gun of the present invention, the magnetic flux density around the cathode may be made a low value. Accordingly, even where the convergence ratio is lower than 10, no magnet need be disposed outwardly of the electron gun. Consequently, the electron gun can be produced with a small size and a light weight. It is to be noted that the convergence ratio is defined, where the radius of the electron emitting area of the FEA type cold cathode 1 is represented by Rc and the average radius of the electron beams is represented by b, by $(Rc/b)^2$.

Furthermore, the first anode electrode 3 having a potential set higher than the body potential Eb of the microwave tube forms a potential barrier against the RF circuit unit 5. Consequently, the first anode electrode 3 plays a role of an ion barrier which prevents positive ions formed by ionization of residual gas of the microwave tube from flowing out from the RF circuit unit 5 toward the FEA type cold cathode 1, and this is very effective to make the life of the cold cathode long.

Meanwhile, from the standpoint of structure, since the electron gun can be formed from, in addition to the FEA type cold cathode 1, the single Wehnelt electrode 2 and the two anode electrode 3 and 4, a small-sized light-weighted electron gun can be realized.

Second Embodiment

Next, a cold cathode electron gun of a second embodiment of the present invention is described with reference to FIG. 9. In the present embodiment, a Wehnelt electrode 2' is disposed in contact with a gate electrode 6 of an FEA type cold cathode 1 so that the Wehnelt potential Ew and the gate potential Eg have an equal potential. Further, the radius Rw of the inner circumferential edge of the Wehnelt electrode 2' is larger than twice the radius Rc of the electron emitting area of the FEA type cold cathode 1. Since the construction of the remaining part of the cold cathode electron gun is same as that of the first embodiment, common elements to those of the first embodiment are denoted by same reference symbols and description of them is omitted here.

According to a simulation performed by the applicant of the present application, where the radius Rw of the inner circumferential edge of the Wehnelt electrode 2' is smaller than twice the radius Rc of the electron emitting area of the FEA type cold cathode 1, electron beams emitted from the FEA type cold cathode 1 are converged so strongly that they cross the center axis. However, by setting the radius Rw to more than twice the radius Rc, electron beams having a better laminar flow property and having a low ripple percentage can be obtained.

A simulation of electron beam trajectories was performed applying the electron gun of the present embodiment to a traveling wave tube wherein a periodic permanent magnet (PPM) is used for the beam converging magnet of the RF circuit unit 5. Conditions and a result of the simulation are given below:

electron beam divergence half angle=15 degrees cathode current=45 mA gate potential Eg=100 V Wehnelt potential Ew=100 V first anode potential Ea1=4,000 V second anode potential Ea2=0 V body potential Eb=3,000 V radius Rc of electron emitting area=0.6 mm inner radius Rw of Wehnelt electrode=1.5 mm magnetic flux density around cathode=54 Gauss PPM main magnetic flux density=1,900 Gauss electron beam convergence ratio=4 electron beam maximum diameter/RF circuit unit inner diameter×100=65.7% ripple percentage=12.6%

Figure 9:
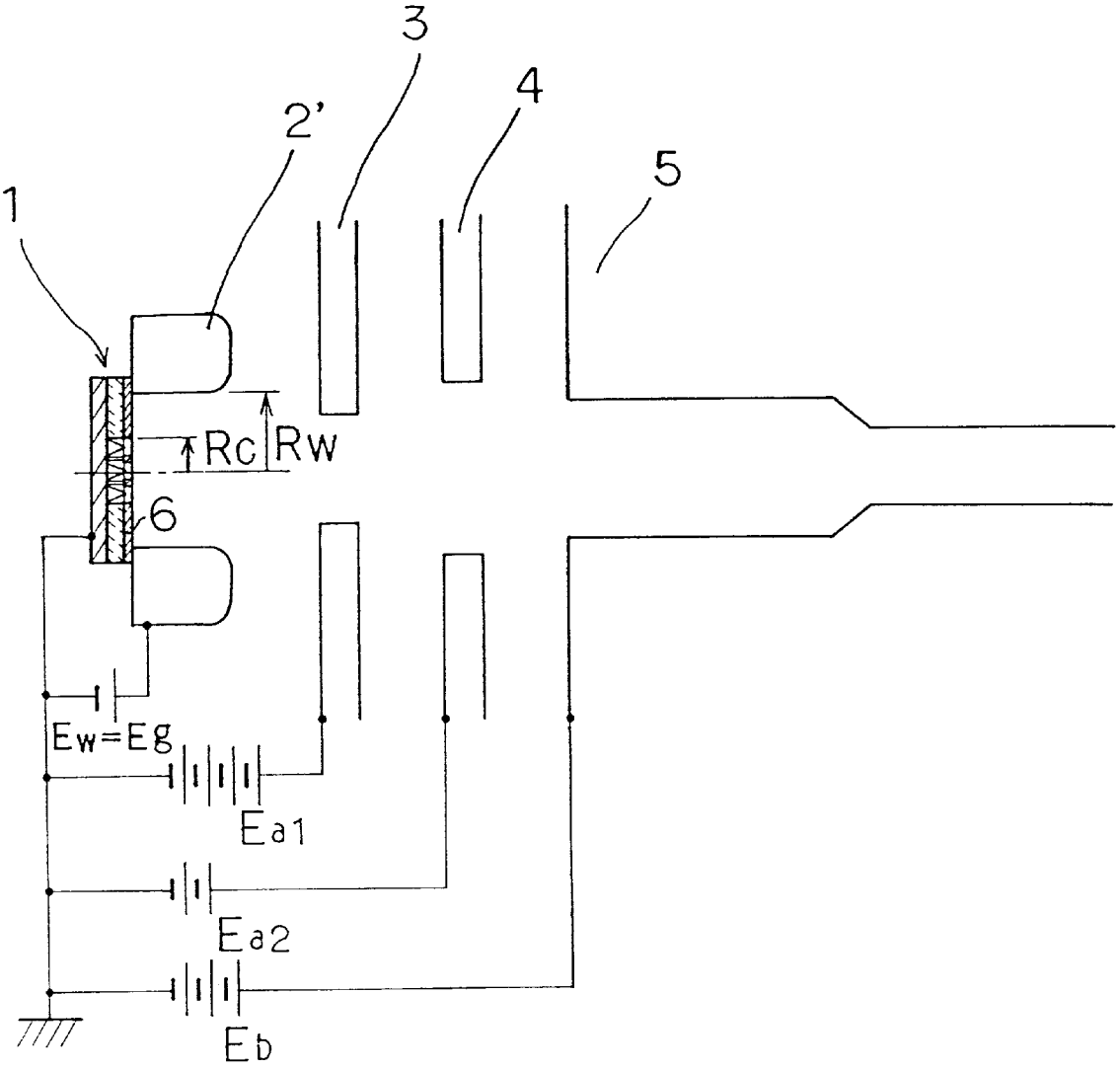
FIG. 9 is a schematic view showing a construction of another cold cathode electron gun and showing a second embodiment of the present invention.
Figure 10:
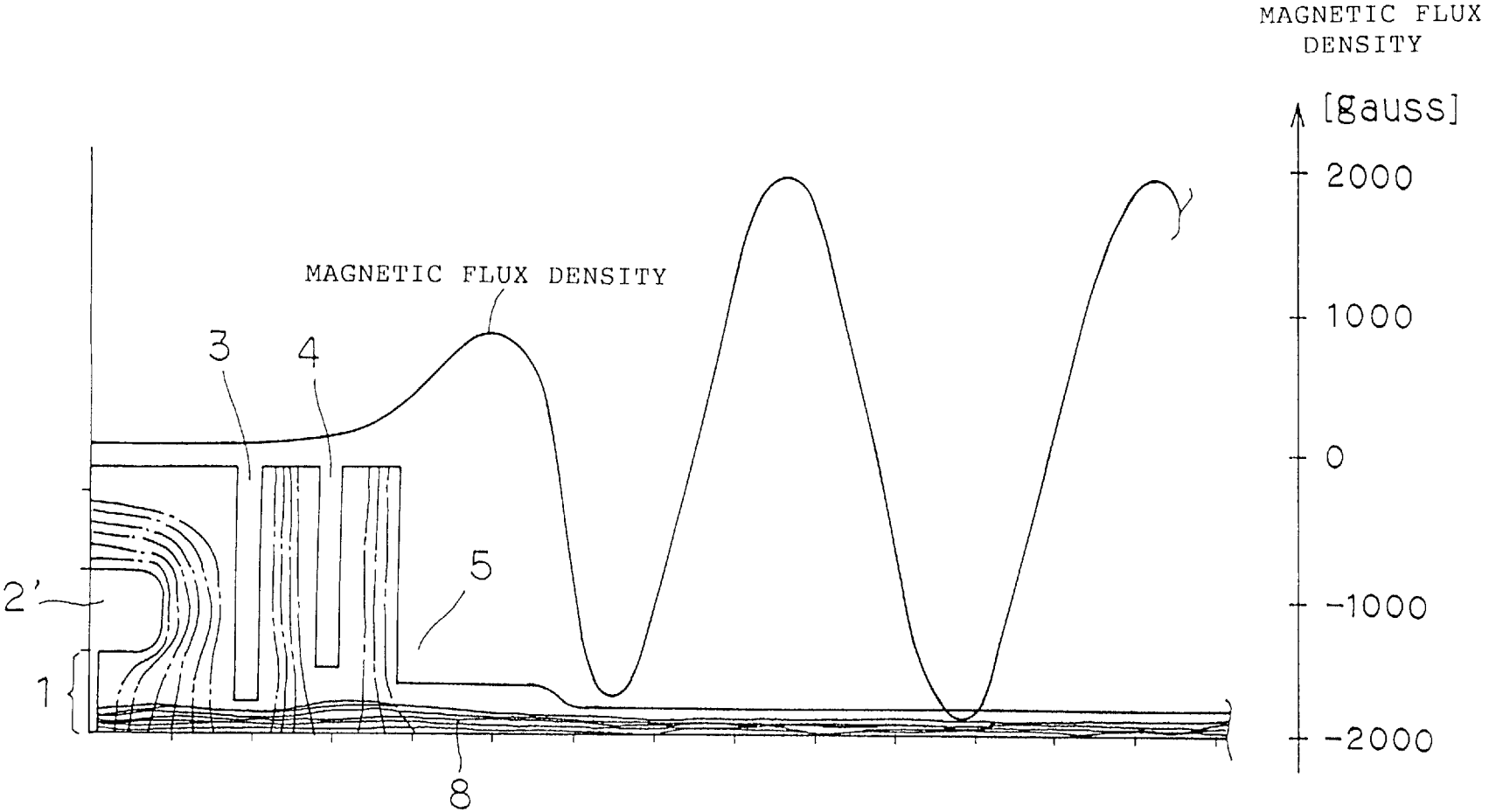
FIG. 10 is a diagrammatic view illustrating a result of a simulation of electron beam trajectories when the cold cathode electron gun shown in FIG. 9 is applied to a traveling wave tube of the PPM converging type.

Trajectories of electron beams by the simulation are shown in FIG. 10 wherein like references labels refer to like parts in FIG. 9.

From FIG. 10, it can be seen that the trajectories of electron beams 8 are very good in that they do not lose their laminar flow property and have a low ripple percentage. It is to be noted that FIG. 10 illustrates, together with the trajectories of the electron beams 8, the magnetic flux density and equipotential lines (alternate long and short dash lines) between the electrodes.

In the simulation result illustrated in FIG. 10, the convergence ratio is approximately 4. Since the optimum convergence ratio varies depending upon the voltages or currents to the electrodes, electron beam divergence half angles and so forth, it should be selected to a suitable value within the range lower than 10.

Figure 11:
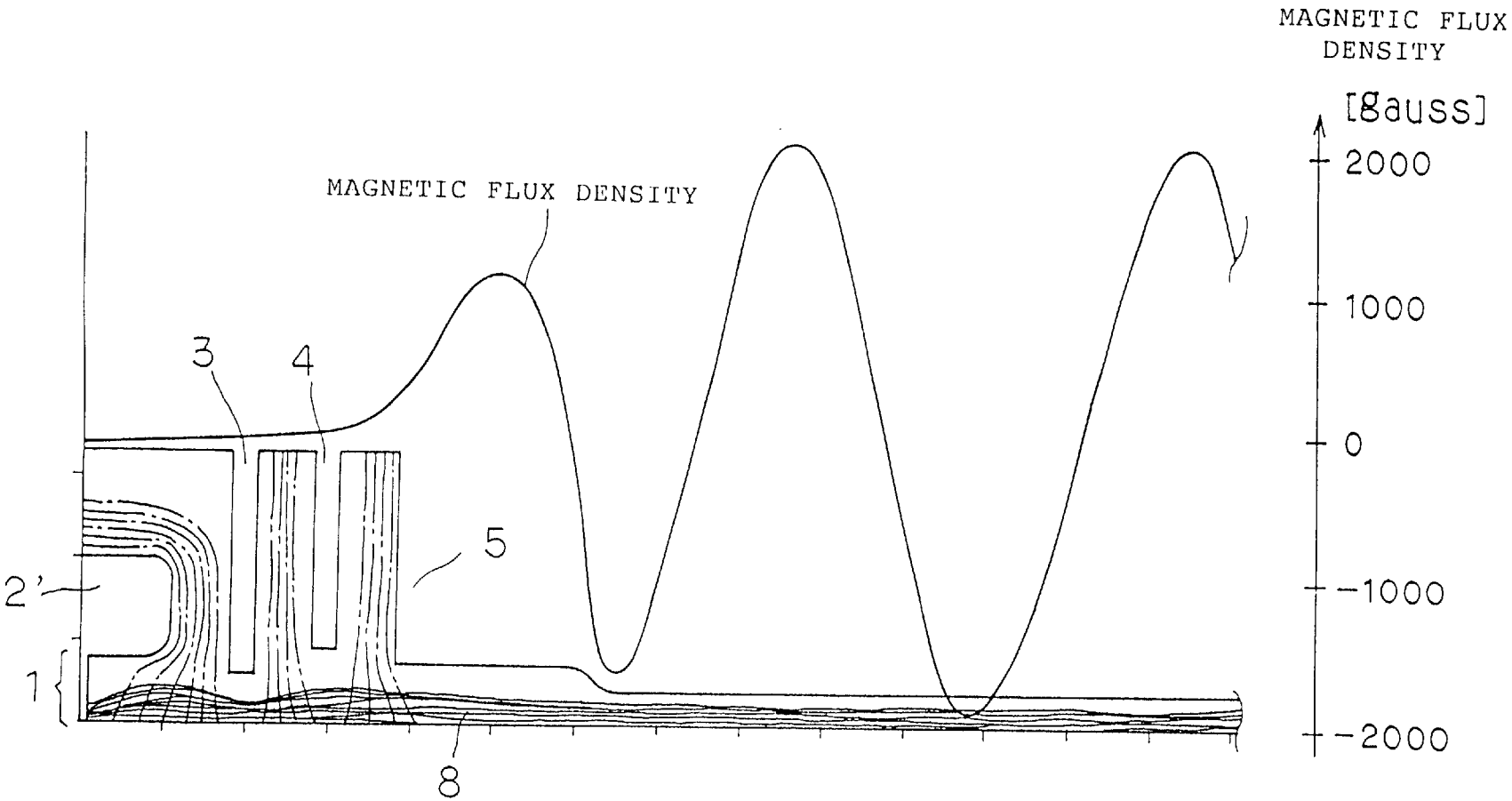
FIG. 11 is a diagrammatic view illustrating a result of a simulation of electron beam trajectories when the electron beam divergence half angle is 25 degrees where the cold cathode electron gun shown in FIG. 9 is applied to the traveling wave tube of the PPM converging type.

Another simulation was performed with the electron beam divergence half angles set to values within the range of 10 to 30 degrees and it was confirmed by the applicant of the present application that good electron beam trajectories can be obtained by suitably selecting the voltages or currents to the electrodes, the beam convergence ratio and the magnetic flux density. FIG. 11 illustrates a result of the simulation of electron beam trajectories where the electron beam divergence half angles were 25 degrees wherein like references labels refer to like parts in FIG. 9. Further, conditions and a result of the simulation are given below:

electron beam divergence half angle=25 degrees cathode current=45 mA gate potential Eg=100 V Wehnelt potential Ew=100 V first anode potential Ea1=6,000 V second anode potential Ea2=0 V body potential Eb=5,000 V radius of electron emitting area Rc=0.3 mm inner radius Rw of Wehnelt electrode=1.05 mm magnetic flux density around cathode=54 Gauss PPM main magnetic flux density=2,100 Gauss electron beam convergence ratio=1 electron beam maximum diameter/RF circuit unit inner diameter×100=63.8% ripple percentage=15.1%

In the simulation, the electron beam divergence half angle was set to 25 degrees, and also the set values of the first anode potential Ea1 and the body potential Eb was varied accordingly. The set values are varied within a range in which the expression (1) is satisfied as apparently seen from the conditions given above.

It is to be noted that also the low noise traveling wave tube described in the Description of the Related Art above has a plurality of anode electrodes. However, the potential distribution in the anode electrodes is such that the potential successively increases from the cathode side toward the RF circuit unit of the microwave tube. Therefore, the converging effect by the electric field lenses between the electrodes is so weak that, although current of up to several hundreds μA can be applied, if current of several tens mA is applied, then the diverging effect of electrons by the space charge force becomes so high that convergence of electron beams are impossible. However, if a structure to which the present invention is applied is employed, then electron beams having a good laminar flow property can be obtained even with current of several tens mA or more.

Meanwhile, with the electron gun for a cathode ray tube of the related art, electron beams are first caused to cross over each other once by potential setting of the control grid electrode and the screen grid electrode which form the beam forming unit and then accelerated and converged by the plurality of converging grid electrodes to form a small spot on the fluorescent screen. Accordingly, with the electron gun for a cathode ray tube, at least four electrodes are required to converge electron beams, and if this construction is applied as it is to an electron gun for a microwave tube, then the structure of the electron gun becomes complicated and large. However, where a structure to which the present invention is applied is employed, since an electron gun can be formed from a single Wehnelt electrode and two anode electrodes, the electron gun can be realized with a small size and a light weight.

Third Embodiment

Figure 12:
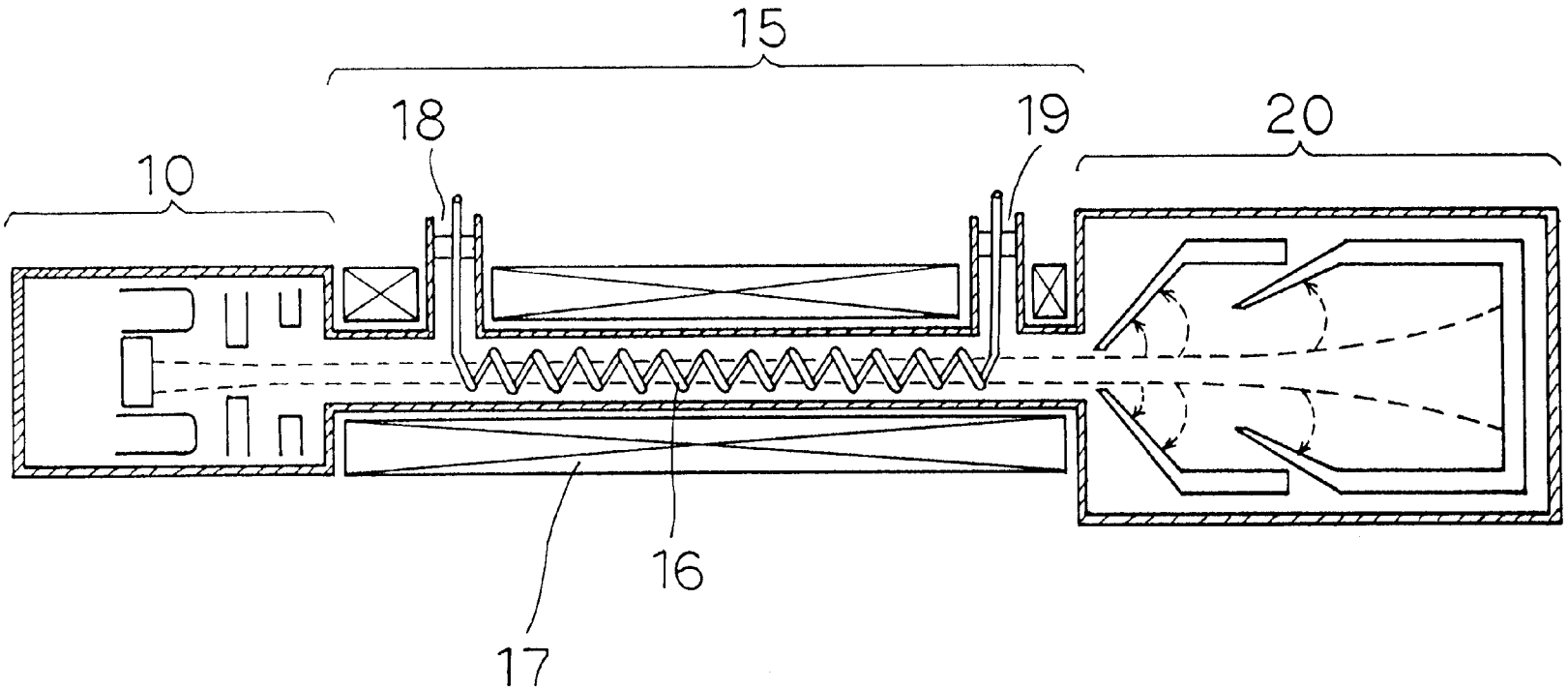
FIG. 12 is a schematic sectional view of a traveling wave tube which adopts a cold cathode electron gun of the present invention.

Now, a traveling wave tube which adopts the cold cathode electron gun of the present invention will be described with reference to FIG. 12.

The traveling wave tube is composed of a cold cathode electron gun 10, an RF circuit unit 15 and a collector 20. For the cold cathode electron gun 10, the cold cathode electron gun of the present invention described in connection with the first embodiment or the second embodiment above is used. The RF circuit unit 15 includes a helix 16 which is a slow wave circuit for adjusting the phase velocity of an inputted microwave so as to be substantially equal to the velocity of an electron beam, and a beam converging magnet 17. A microwave is inputted and outputted through an input window 18 and an output window 19, respectively. For the beam converging magnet 17, usually a periodic permanent magnet is used. Based on the construction described above, an electron beam emitted from the cold cathode electron gun 10 passes through the helix 16, whereupon it amplifies a microwave, and is then caught by the collector 20.

Since the traveling wave tube of the present embodiment employs the cold cathode electron gun of the present invention, the following effects are achieved. First, since no heating is required in order to emit electrons, no heater power is required. Further, since the electron gun is reduced in size and weight significantly, also reduction in size and weight of the overall traveling wave tube can be achieved. Furthermore, where a traveling wave tube for a millimeter wave band is involved, since the diameter of the electron beam is small, if the beam convergence ratio is maintained to a fixed value so that a stable beam transmission characteristic may be obtained using a hot cathode electron gun, then the cathode current density becomes excessively high, and therefore, it is difficult to put a hot cathode electron gun into practical use in terms of the life. However, where the cold cathode electron gun is used, since the cathode current density can be set higher than ten times that of a hot cathode, it does not have any problem also in terms of the life in practical use. It is to be noted that, in regard to the life, also the construction that the first anode electrode of the cold cathode electron gun plays a role also of an ion barrier contributes to increase in life of the traveling wave tube. Further, since electron beams of a high quality having a good laminar flow property and having a low ripple percentage can be obtained, not only a good electron beam transmission characteristic can be achieved but also a stabilized radio frequency characteristic can be achieved.

While, in the present embodiment, an example wherein a helix is used as the slow wave circuit of the RF circuit unit, the slow wave circuit is not limited to a helix, and a circuit of the cavity coupling type maybe used. Further, the cold cathode electron gun of the present invention can be used not only to a traveling wave tube but also to various microwave tubes such as a klystron.

While preferred embodiments of the present invention have been described using specific terms, such description is for illustrative purposes only, and it is to be understood that changes and variations may be made without departing from the spirit or scope of the following claims.

What is claimed is:

1. A cold cathode electron gun usable in a microwave tube which includes an RF circuit unit, comprising:

a field emission cathode array type cold cathode for emitting electron beams; and an annular Wehnelt electrode, a first anode electrode and a second anode electrode disposed in order between said field emission cathode array type cold cathode and said RF circuit unit;

where a potential of said first anode electrode is represented by Ea1, a potential of said second anode electrode is represented by Ea2 and a potential of said RF circuit unit is represented by Eb, the potentials having a relationship of $$Ea\mathbf{1}>Eb>Ea\mathbf{2}\geqq 0 \text{ V.}$$

2. A cold cathode electron gun according to claim 1, wherein, where a radius of an electron emitting area of said field emission cathode array type cold cathode is represented by Rc and an average radius of the electron beams is represented by b, an electron beam convergence ratio represented by $(Rc/b)^2$ is lower than 10.

3. A cold cathode electron gun according to claim 1, wherein a radius of an inner circumference of said Wehnelt electrode is larger than twice a radius of an electron emitting area of said field emission cathode array type cold cathode, and a potential of said Wehnelt electrode is equal to a potential of a gate of said field emission cathode array type cold cathode.

4. A microwave tube, comprising:

an electron gun for forming an electron beam;

an RF circuit unit for amplifying a microwave signal by a mutual action between the microwave signal and the electron beam from said electron gun; and a collector for catching the electron beam which has passed through said RF circuit unit;

said electron gun including:

a field emission cathode array type cold cathode for emitting electron beams; and an annular Wehnelt electrode, a first anode electrode and a second anode electrode disposed in order between said field emission cathode array type cold cathode and said RF circuit unit;

where a potential of said first anode electrode is represented by Ea1, a potential of said second anode electrode is represented by Ea2 and a potential of said RF circuit unit is represented by Eb, the potentials having a relationship of $$Ea\mathbf{1}>Eb>Ea\mathbf{2}\geqq 0 \text{ V.}$$

5. A microwave tube according to claim 4, wherein, where a radius of an electron emitting area of said field emission cathode array type cold cathode is represented by Rc and an average radius of the electron beams is represented by b, an electron beam convergence ratio represented by $(Rc/b)^2$ is lower than 10.

6. A microwave tube according to claim 4, wherein a radius of an inner circumference of said Wehnelt electrode is larger than twice a radius of an electron emitting area of said field emission cathode array type cold cathode, and a potential of said Wehnelt electrode is equal to a gate potential of said field emission cathode array type cold cathode.

* * * * *